US009517821B2

(12) United States Patent
Ford et al.

(10) Patent No.: US 9,517,821 B2
(45) Date of Patent: Dec. 13, 2016

(54) RECOVERY SYSTEMS AND METHODS FOR UNMANNED UNDERWATER VEHICLES

(71) Applicant: The Boeing Company, Chicago, IL (US)

(72) Inventors: Thomas S. Ford, Corona, CA (US); Derek A. Ahern, Orange, CA (US)

(73) Assignee: The Boeing Company, Chicago, IL (US)

( * ) Notice: Subject to any disclaimer, the term of this patent is extended or adjusted under 35 U.S.C. 154(b) by 170 days.

(21) Appl. No.: 14/481,113

(22) Filed: Sep. 9, 2014

(65) Prior Publication Data

US 2016/0068244 A1 Mar. 10, 2016

(51) Int. Cl.
*B63G 8/14* (2006.01)
*B63G 8/24* (2006.01)

(52) U.S. Cl.
CPC .. *B63G 8/14* (2013.01); *B63G 8/24* (2013.01)

(58) Field of Classification Search
CPC ..... B63G 8/14; B63G 8/24
See application file for complete search history.

(56) References Cited

U.S. PATENT DOCUMENTS 3,157,145 A * 11/1964 Farris ..... B63G 8/08 114/332
6,021,731 A 2/2000 French et al.
6,158,370 A * 12/2000 French ..... B63G 8/22 114/121
8,047,590 B1 * 11/2011 Hamme ..... B66C 1/66 294/66.1
8,875,645 B1 * 11/2014 Webb ..... G01C 13/00 114/312
2013/0327263 A1 * 12/2013 Sparks ..... B63C 7/02 114/54

FOREIGN PATENT DOCUMENTS

JP 62194198 12/1987

* cited by examiner

*Primary Examiner* — Stephen Avila
(74) *Attorney, Agent, or Firm* — Duft Bornsen & Fettig LLP

(57) ABSTRACT

Embodiments described herein provide a highly reliable UUV recovery systems and methods that utilize multiple independent release mechanisms that can detach a load and allow the UUV to float to the surface of the water. One embodiment is a recovery system for a UUV. The recovery system includes a detachable load that renders the UUV neutrally buoyant in water. The recovery system further includes a plurality of release mechanisms that detach the load to render the UUV positively buoyant in the water. The release mechanisms include a first, second, and third release mechanism. The first release mechanism detaches the load in response to a command signal. The second release mechanism detaches the load in response to the UUV being submerged in the water beyond a threshold time. The third release mechanism detaches the load in response to the UUV exceeding a maximum depth in the water.

19 Claims, 9 Drawing Sheets

RECOVERY SYSTEMS AND METHODS FOR UNMANNED UNDERWATER VEHICLES

FIELD

This disclosure relates to the field of recovery of Unmanned Underwater Vehicles (UUVs).

BACKGROUND

UUVs may be irretrievably lost during underwater operation and be unable to return to the surface for a number of reasons. The UUV may inadvertently travel below a design depth, may be caught by debris or mud, may lose power and be unable to return to the surface, etc. By design, UUVs are often neutrally buoyant, which may require the UUV to utilize a propulsion system to return to the surface. However, propulsion may not be available when power is lost or the UUV incurs software and/or computer failures. The result is that the UUV may drift under water, making recovery nearly impossible.

SUMMARY

Embodiments described herein provide UUV recovery systems and methods that utilize multiple independent release mechanisms that can detach a load and allow the UUV to float to the surface of the water. The independent release mechanisms are each capable of releasing the load from the UUV utilizing different release criteria, thereby rendering the UUV positively buoyant when various conditions are met.

One embodiment is a recovery system for a UUV. The recovery system includes a detachable load that renders the UUV neutrally buoyant in water. The recovery system further includes a plurality of release mechanisms that are configured to detach the load to render the UUV positively buoyant in the water. The release mechanisms include a first, second, and third release mechanism. The first release mechanism is configured to detach the load in response to a command signal. The second release mechanism is configured to detach the load in response to the UUV being submerged in the water beyond a threshold time. The third release mechanism is configured to detach the load in response to the UUV exceeding a maximum depth in the water.

Another embodiment is a recovery system for a UUV. The recovery system includes a detachable load, a first release mechanism, a second release mechanism, and a third release mechanism. The load is configured to render the UUV positively buoyant in water upon release. The first release mechanism is configured to detach the load in response to a command signal. The second release mechanism is configured to detach the load in response to the UUV being submerged in the water beyond a threshold time. The third release mechanism is configured to detach the load in response to the UUV exceeding a maximum depth in the water.

Another embodiment is a method for operating a recovery system for an Unmanned Underwater Vehicle (UUV). The method comprises affixing a detachable load that renders the UUV neutrally buoyant in water. The method further comprises detaching the load in response to a command signal to render the UUV positively buoyant in the water. The method further comprises detaching the load in response to the UUV being submerged in the water beyond a threshold time to render the UUV positively buoyant in the water. The method further comprises detaching the load in response to the UUV exceeding a maximum depth in the water to render the UUV positively buoyant in the water.

The above summary provides a basic understanding of some aspects of the specification. This summary is not an extensive overview of the specification. It is intended to neither identify key or critical elements of the specification nor delineate any scope of the particular embodiments of the specification, or any scope of the claims. Its sole purpose is to present some concepts of the specification in a simplified form as a prelude to the more detailed description that is presented later.

DESCRIPTION OF THE DRAWINGS

Some embodiments are now described, by way of example only, and with reference to the accompanying drawings. The same reference number represents the same element or the same type of element on all drawings

DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
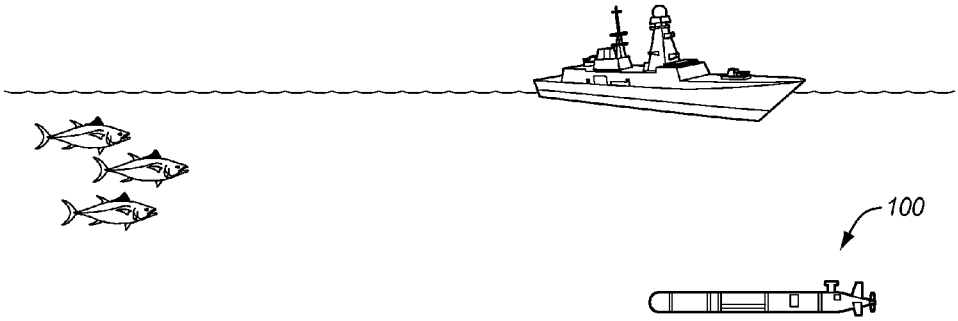
FIG. 1 illustrates a vehicle that utilizes a recovery system in an exemplary embodiment.

FIG. 1 illustrates a submersible vehicle 100 that utilizes a recovery system in an exemplary embodiment. In this embodiment, vehicle 100 is depicted as an Unmanned Underwater Vehicle (UUV), although in other embodiments, vehicle 100 may be any type of vehicle that is able to submerge under water and utilize a recovery system to ensure that vehicle 100 may be recovered at the surface when various recovery criteria are met. For instance, vehicle 100 may inadvertently dive past a pre-determined depth, which triggers the recovery system to return vehicle 100 to the surface. Vehicle 100 may exceed a pre-determined amount of time under water, which triggers the recovery system to return vehicle 100 to the surface. Vehicle 100, or some other entity, may generate a command signal which triggers the recovery system to return vehicle 100 to the surface.

Figure 2:
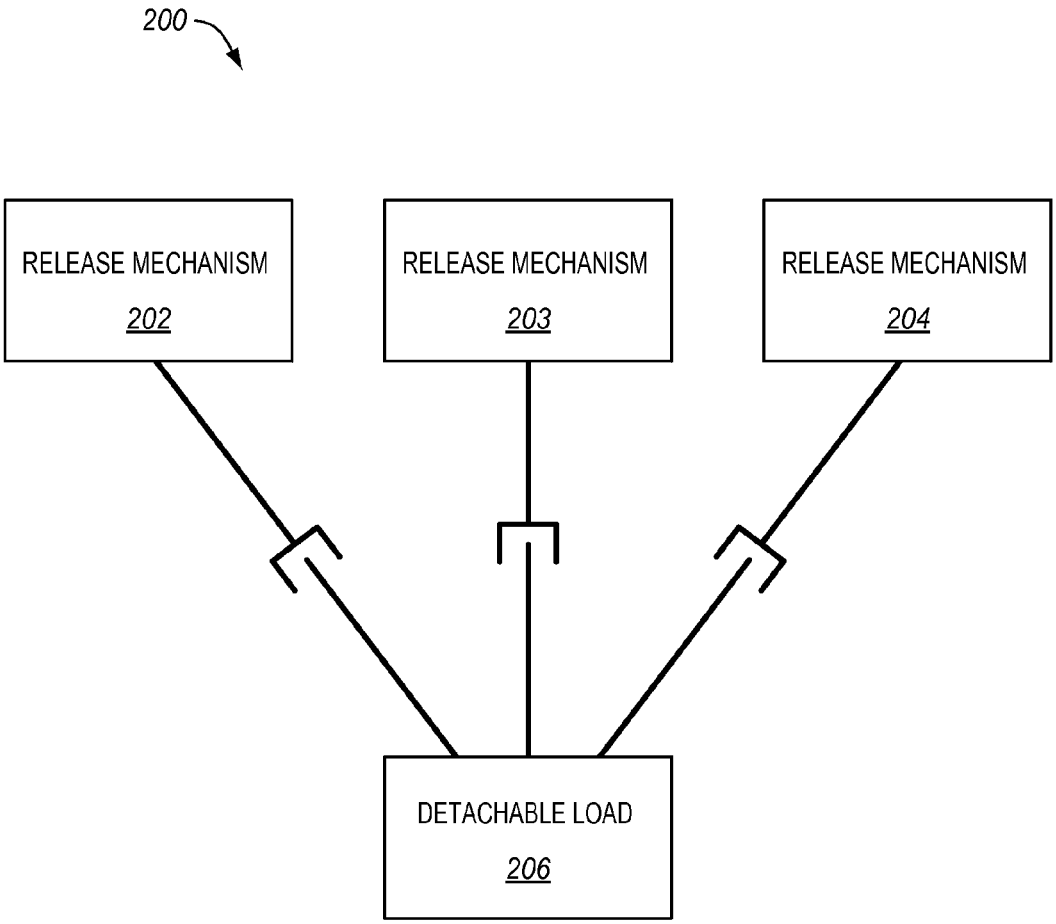
FIG. 2 is a block diagram of a recovery system for the vehicle of FIG. 1 in an exemplary embodiment.

FIG. 2 is a block diagram of a recovery system 200 for vehicle 100 of FIG. 1 in an exemplary embodiment. In this embodiment, recovery system 200 includes a plurality of release mechanisms 202-204 that are mechanically coupled to a detachable load 206. Load 206 may include a portion of vehicle 100 and/or a drop weight that is able to be detached from vehicle 100 in some embodiments. In this embodiment, load 206 renders vehicle 100 substantially neutrally buoyant in water, and renders vehicle 100 positively buoyant in water when load 206 is released from vehicle 100. When load 206 is released, vehicle 100 is able to float to the surface of the water and be recovered.

Release mechanisms 202-204 operate substantially independently to ensure that load 206 is detached from vehicle 100 when certain conditions are met. This ensures vehicle 100 may be recovered. Release mechanism 202 in this embodiment comprises any component, system, or device that is able to detach load 206 in response to a command signal. The command signal may be generated by vehicle 100 and/or by another entity, such as a support vessel. For instance, vehicle 100 may generate a command signal to detach load 206 if vehicle 100 becomes stuck and is unable to surface (e.g., stuck in mud, ensnared in fishing gear, etc.).

Release mechanism 203 in this embodiment comprises any component, system, or device that is able to detach load 206 in response to vehicle 100 being submerged in the water beyond a pre-determined time. For instance, if vehicle 100 loses power and drifts under water beyond a pre-determined amount time, then release mechanism 203 acts to detach load 206 and cause vehicle 100 to float to the surface of the water.

Release mechanism 204 in this embodiment comprises any component, system, or device that is able to detach load 206 in response to vehicle 100 exceeding a maximum depth in the water. For instance, if vehicle 100 loses power or becomes negatively buoyant, then vehicle 100 may sink below a pre-determined depth in the water. In this case, release mechanism 204 acts to detach load 206 and cause vehicle 100 to float to the surface of the water.

Because release mechanisms 202-204 act substantially independently of each other to detach load 206 and render vehicle 100 positively buoyant, vehicle 100 is more likely to be recovered on the surface of the water in response to a variety of possible failures that may otherwise cause vehicle 100 to be lost.

Figure 3:
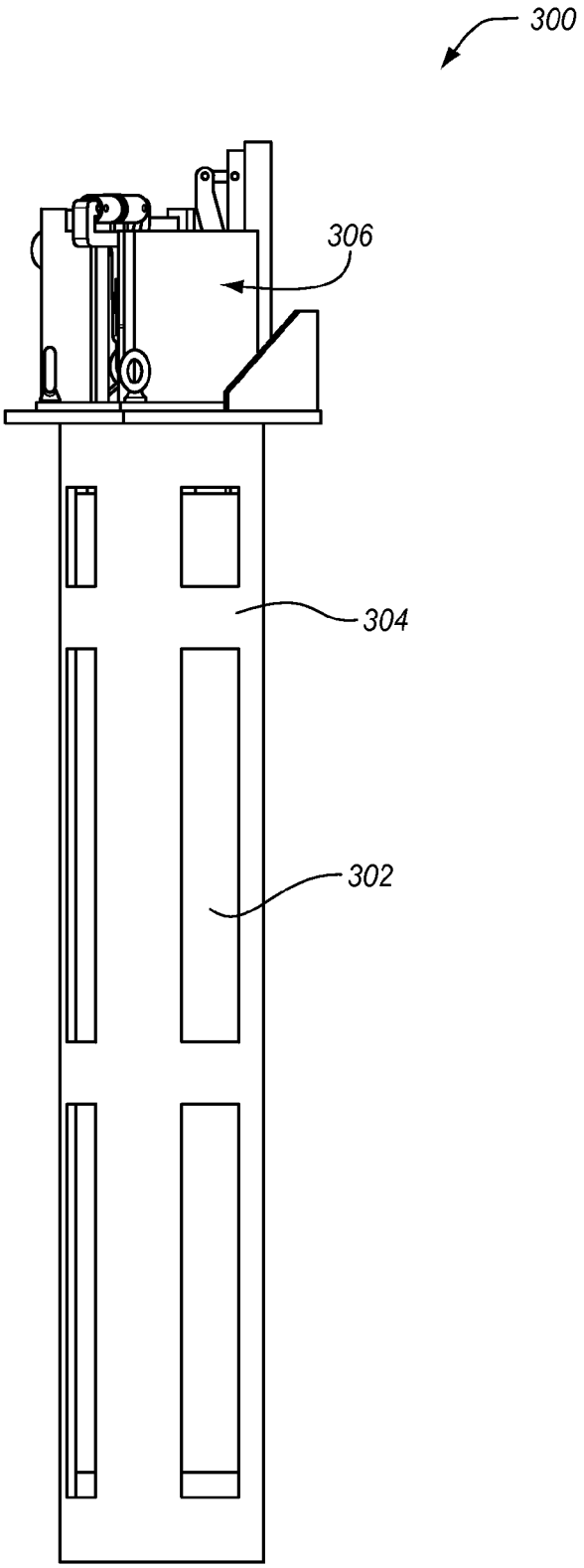
FIG. 3 is an isometric view of another recovery system for the vehicle of FIG. 1 in an exemplary embodiment.

FIG. 3 is an isometric view of another recovery system 300 for vehicle 100 in an exemplary embodiment. In this embodiment, recovery system 300 includes a plurality of release mechanisms (not visible in this view) which are surrounded by a housing 306. Housing 306 of recovery system 300 is fixed to a shell 304, which surrounds a detachable load 302. In this embodiment, load 302 is a drop weight, although in other embodiments load 302 may include portion(s) of vehicle 100. For instance, load 302 may be an instrument package for vehicle 100, may be external lights for vehicle 100, etc. Thus, it is not intended that load 302 in this embodiment be limited to only drop weights.

In this embodiment, load 302 is able to slide within shell 304 and detach from recovery system 300 when certain conditions are met. While load 302 remains connected to recovery system 300 (which is part of or is mounted to vehicle 100), vehicle 100 is approximately neutrally buoyant. This allows vehicle 100 to operate under water without incurring a buoyancy penalty (e.g., either positively or negatively) when utilizing recovery system 300. However, when load 302 is dropped, released, detached, etcetera, from recovery system 300 (and consequentially also from vehicle 100), vehicle 100 becomes positively buoyant. With positive buoyancy, vehicle 100 floats to the surface of the water, which allows for the recovery of vehicle 100.

Figure 4:
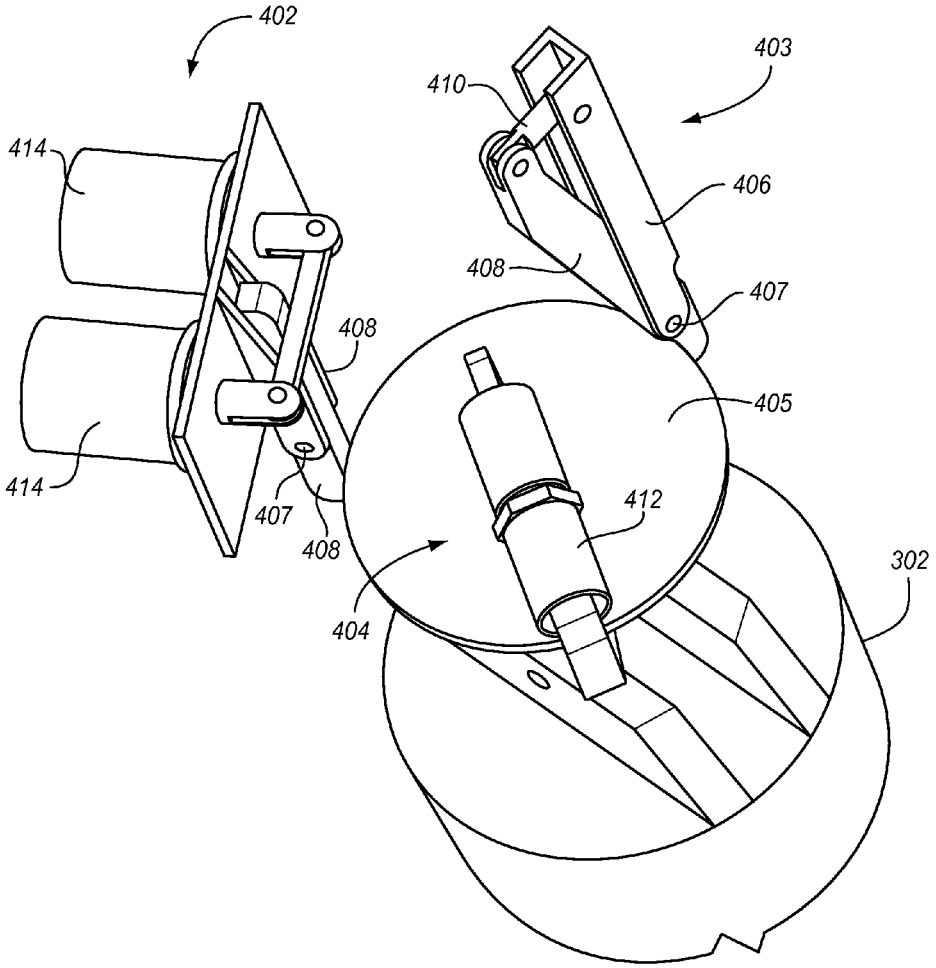
FIG. 4 is an isometric view of a plurality of release mechanisms for the recovery system of FIG. 3 in an exemplary embodiment.

FIG. 4 is an isometric view of release mechanisms 402-404 for recovery system 300 of FIG. 3 in an exemplary embodiment. In this view, housing 306 (see FIG. 3) has been removed to allow for the visibility of release mechanisms 402-404. In this embodiment each of release mechanisms 402-404 are capable of operating independently to detach load 302 from recovery system 300. Release mechanisms 402-404 are detachably coupled to a disk 405, which is mounted to load 302. However, in other embodiments, release mechanisms 402-404 may be detachably coupled to load 302 in any number of ways as a matter of design choice. Further, although disk 405 is depicted as substantially round, disk 405 may include other shapes as well. For instance, disk 405 may oblong, rectangular, triangular, etc. Disk 405 may be referred to as a weigh distribution plate in some embodiments.

Release mechanism 402 in this embodiment is an active release, and is able to detach load 302 from recovery system 300 in response to receiving a command signal. For instance, vehicle 100 may generate a command signal to detach load 302 from recovery system 300. Release mechanism 402 includes a pair of redundant actuator coils 414 which are used to release load 302, although in other embodiments only one coil 414 may be used. Vehicle 100, or some other entity such as a ship or an operator, may generate the command signal to release load 302 in cases where vehicle 100 is unable to return to the surface. For example, if a propulsion system for vehicle 100 fails, then vehicle 100 may generate the command signal actuating coils 414. Coils 414 are mechanically coupled to a fixed arm 406 (which may be bonded to housing 306) and hold a movable arm 408 in place until coils 414 are actuated. Movable arm 408 is rotatably coupled to fixed arm 406 by a pin 407. Upon actuation, movable arm 408 rotates out of position along a pin 407 coupled to fixed arm 408, which causes movable arm 408 to decouple from disk 405 and release load 302 from shell 304. This imparts positive buoyancy to vehicle 100 and allows vehicle 100 to float to the surface of the water for recovery.

Release mechanism 403 in this embodiment is a passive release, and is able to detach load 302 from recovery system 300 in response to how long recovery system (and consequentially vehicle 100) is in and/or under the water. Release mechanism 403 may include a breakable link 410, which corrodes in salt water at a known rate. When link 410 breaks, movable arm 408 rotates with respect to fixed arm 406 (which may be bonded to housing 306) along pin 407, which causes movable arm 408 to decouple from disk 405 and allows load 302 to be released from shell 304. For example, if vehicle 100 loses power or becomes entangled or trapped under water, link 410 eventually corrodes until link 410 breaks, which detaches load 302 from recovery system 300. This imparts positive buoyancy to vehicle 100, which is able to float to the surface and be recovered.

Release mechanism 404 in this embodiment is another passive release, and is able to detach load 302 from recovery system 300 in response to recovery system 300 (and consequentially vehicle 100), exceeding a maximum depth. Release mechanism 404 may include a burst plug 412 or some other device which actuates in response to a pressure setting. For instance, if vehicle 100 sinks below a predetermined depth in the water, burst plug 412 ruptures and causes load 302 to be released from recovery system 300. This imparts positive buoyancy to vehicle 100 and allows vehicle 100 to float to the surface of the water and be recovered. The particulars of how release mechanism 404 may operate will be discussed with respect to FIG. 5.

Figure 5:
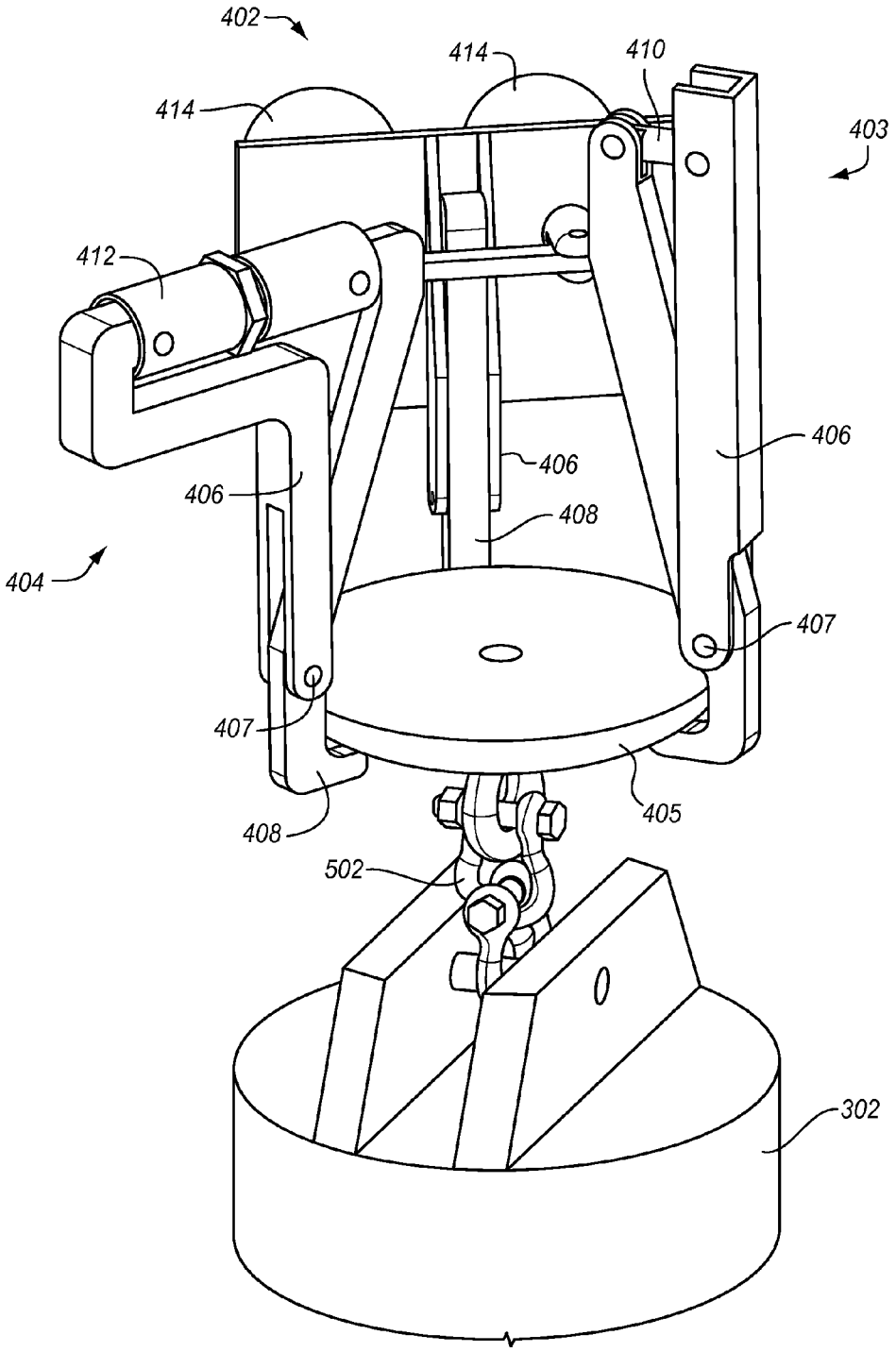
FIG. 5 is an isometric view of a cable and disk assembly for the recovery system of FIG. 3 in an exemplary embodiment.

FIG. 5 is an isometric view of a cable 502 and disk 405 assembly for the recovery system of FIG. 3 in an exemplary embodiment. In this view, the relationship between disk 405 and movable arms 408 is more clearly shown. Movable arms 408 include a hooked portion which allows disk 405 to be held or captured in place until any of movable arms 408 rotate out of position. Load 402 in this view is coupled to disk 405 utilizing a linkage and/or cable 502. This allows load 402 to hang by cable 502 and remain part of recovery system 300 until disk 405 is dropped or titled out of position between movable arms 408. Although FIG. 5 illustrates that each of movable arms 408 are located approximately equidistant around disk 405, other configurations may exist. Referring again to release mechanism 404, burst plug 412 couples movable arm 408 to fixed arm 406 (which may be bonded to housing 306) until burst plug 412 ruptures. In response to burst plug 412 rupturing, movable arm 408 rotates out of position with respect to fixed arm 406 along pin 407, which causes movable arm 408 to decouple from disk 405 and allows load 302 to be released from shell 304.

Figure 6:
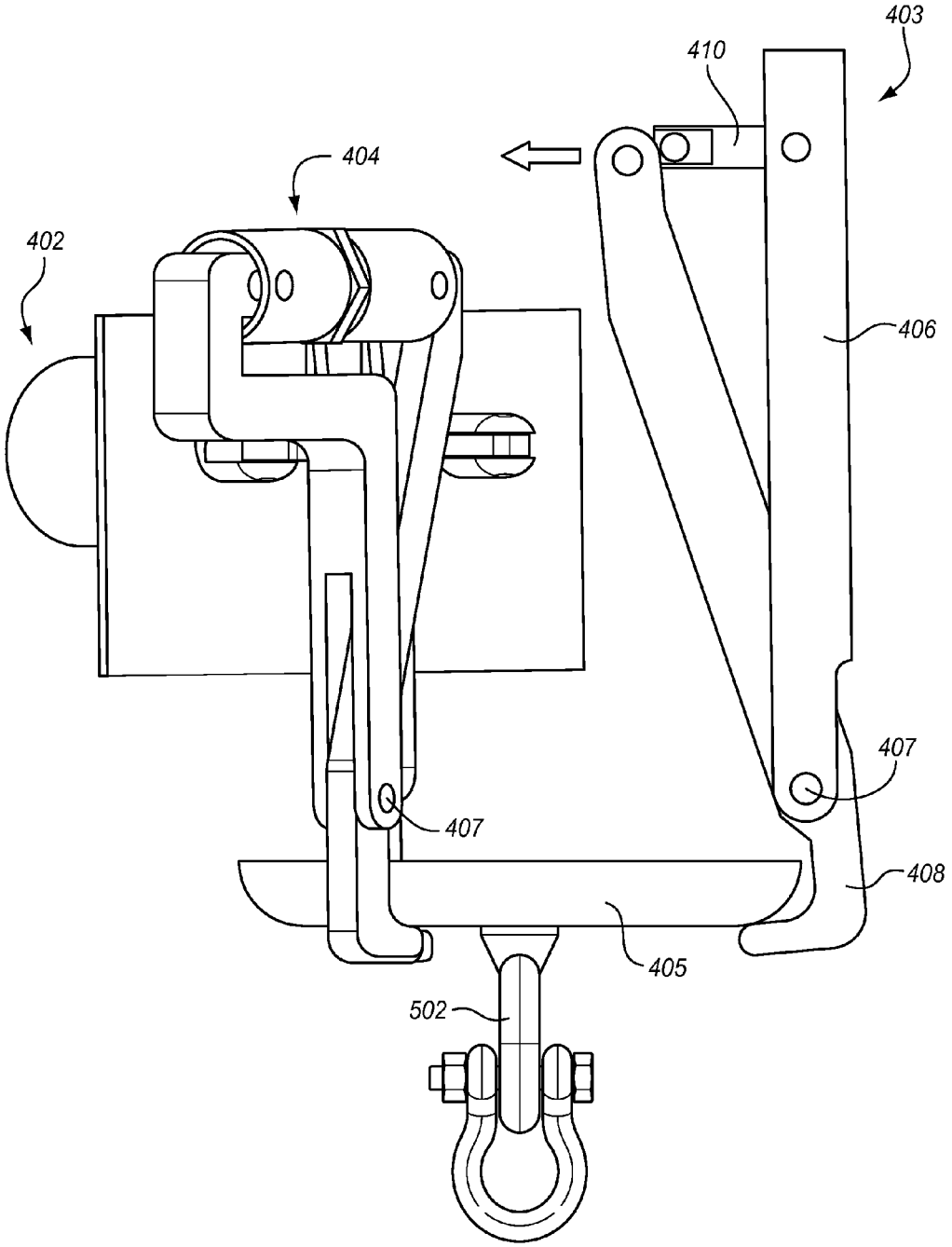
FIGS. 6-8 illustrate a release scenario for detaching a load in an exemplary embodiment.
Figure 7:
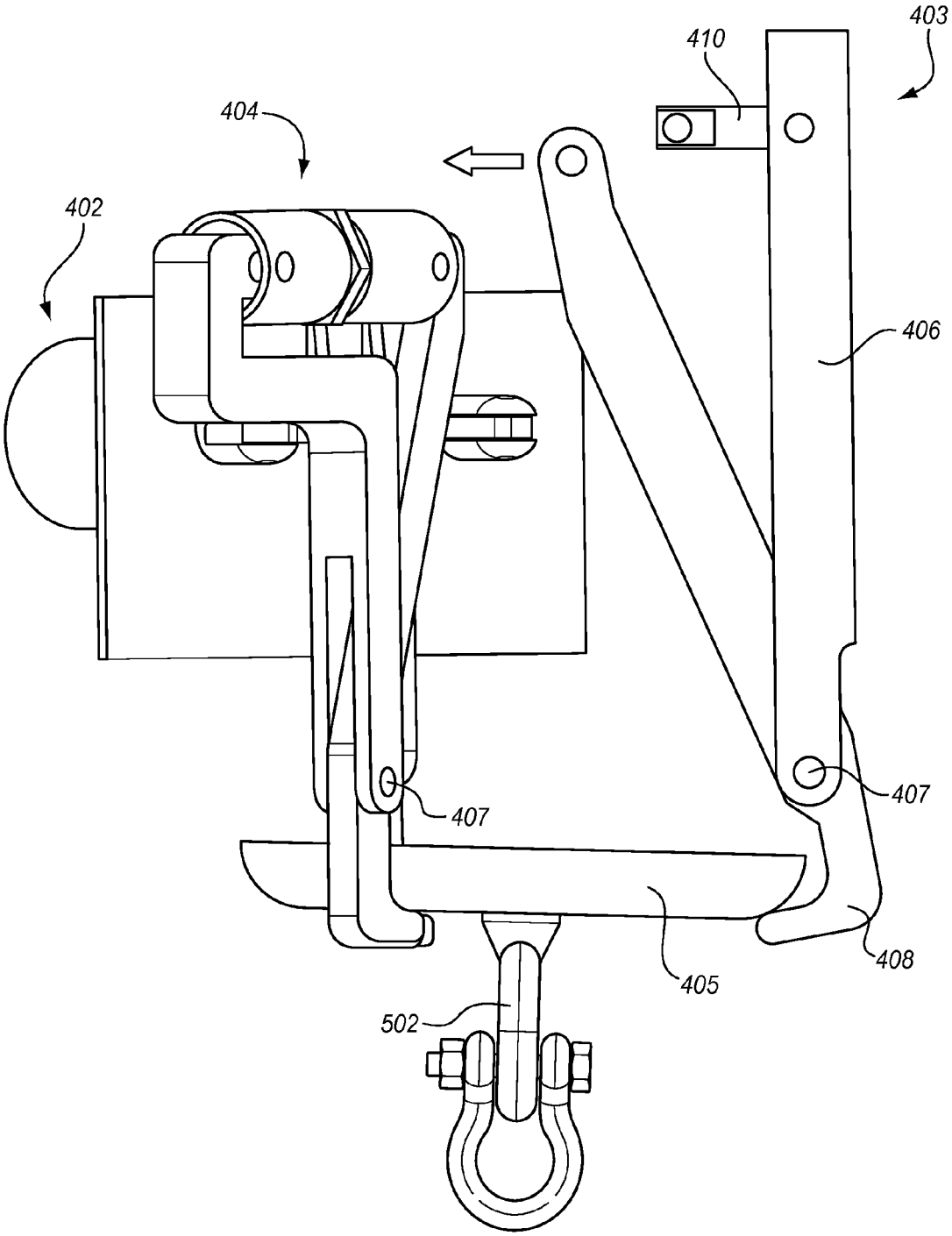
Figure 8:
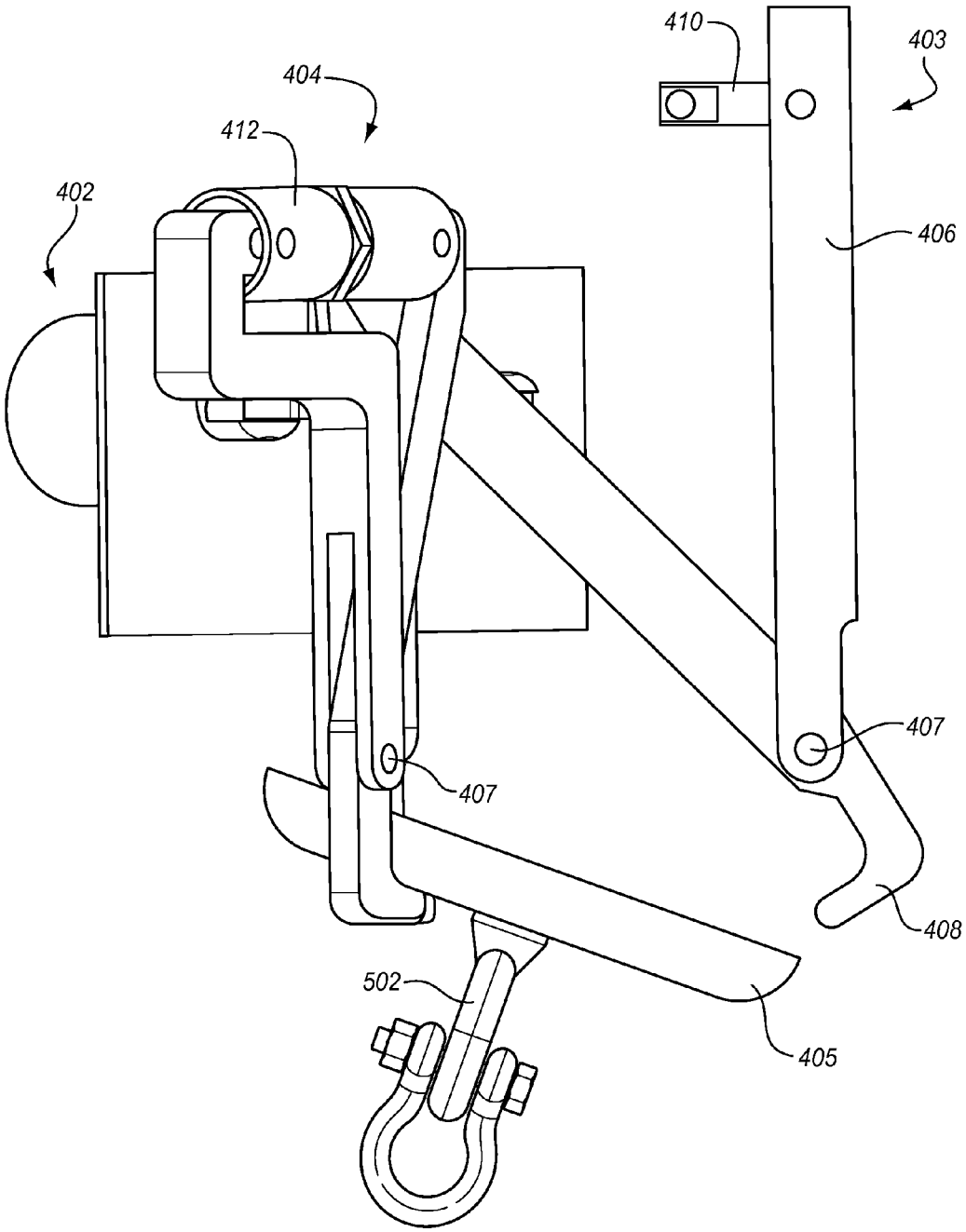

FIGS. 6-8 illustrate a release scenario for detaching load 302 in an exemplary embodiment. Although FIGS. 6-8 illustrate the actuation of release mechanism 403, which is based on the amount of time vehicle 100 is in and/or under the water, any of the other release mechanisms 404-405 may operate in a similar manner to allow disk 405 to rotate out of position and release load 302 from recovery system 300.

In FIG. 6, link 410 is illustrated as releasing movable arm 408, which pivots movable arm 408 toward the left in FIG. 6 along pin 407. As movable arm 408 rotates, the capture of disk 405 is lost. Disk 405 begins to tilt, as illustrated in FIG. 7. As disk 405 tilts and capture is lost (see FIG. 8), disk 405 becomes unstable and is able to slide out of position between movable arms 408 for each of release mechanisms 402-404. As disk 405 is mechanically coupled to load 302 via cable 502, load 302 is able to drop away from recovery system 300, which then imparts positive buoyancy to vehicle 100. Vehicle 100 is then able to float to the surface of the water for recovery.

Figure 9:
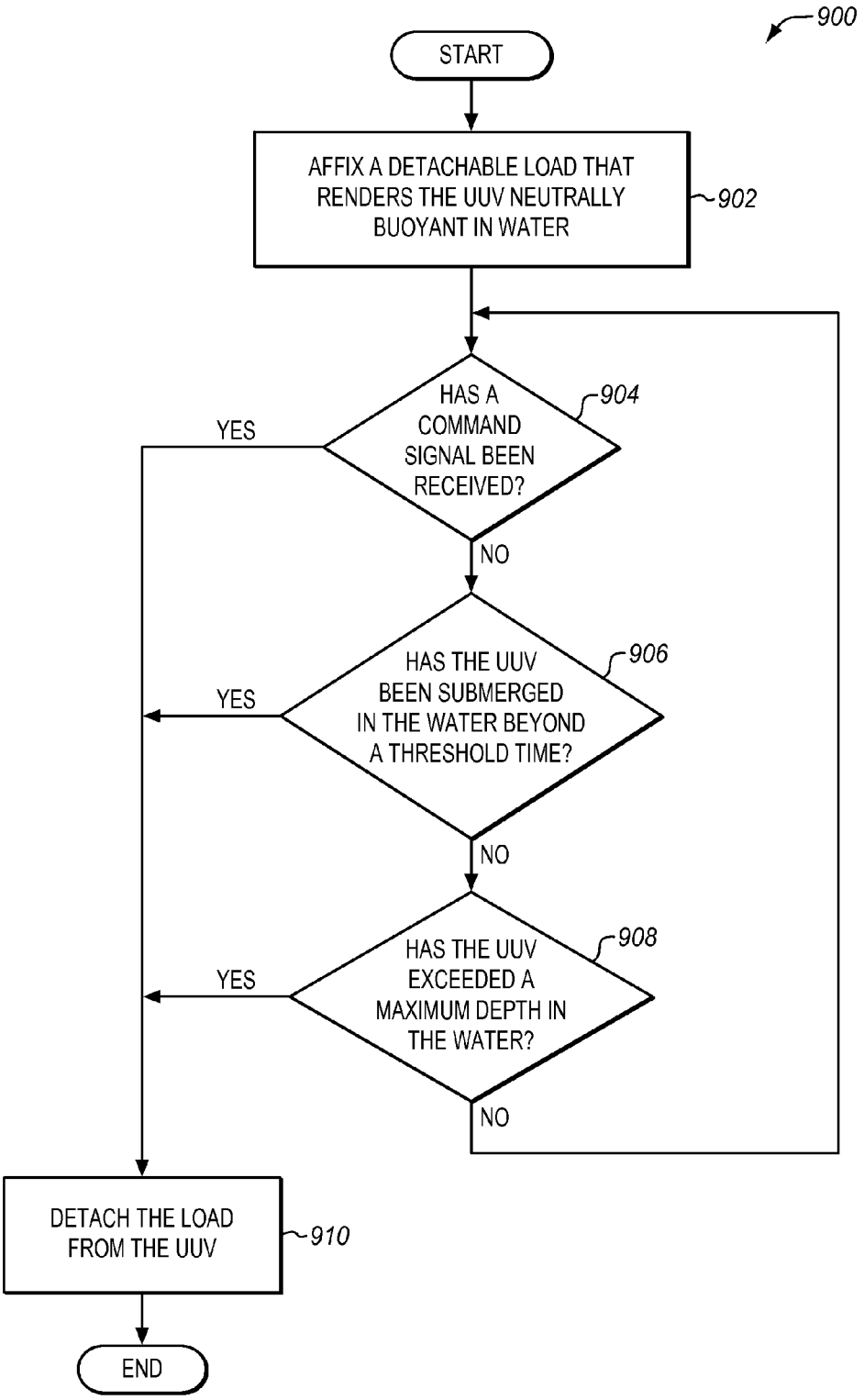
FIG. 9 is a flow chart of a method of operating the recovery systems of FIGS. 2-3 in an exemplary embodiment.

One advantage of recovery system 300 is that it includes a plurality of independent release mechanisms 402-404, each of which are capable of releasing load 302 and allowing vehicle 100 to float to the surface. FIG. 9 is a flow chart of a method 900 of operating the recovery system of FIGS. 2-8 in an exemplary embodiment. The steps of method 900 will be described with respect to recovery system 200; although one skilled in the art will understand that method 900 may be performed by other devices or systems not shown. The steps of method 900 are not all inclusive and may include other steps not shown. Further, the steps may be performed in an alternate order.

In step 902, a detachable load (e.g., load 206) is affixed to a UUV (e.g., vehicle 100). The load may be part of the UUV and/or a drop weight, or some combination thereof. In step 904, if a command signal has been received, then the load is detached from the UUV in step 910 and the UUV floats to the surface. If a command signal has not been received, then step 906 is performed. In step 906, if the UUV has been submerged under water beyond a time limit, then the load is detached in step 910 and the UUV floats to the surface. If the UUV has not been submerged beyond the time limit, then step 908 is performed. In step 908, if the UUV has sunk below a pre-determined depth under the water, then the load is detached in step 910 and the UUV floats to the surface. Each of steps 904-908 may be performed nearly simultaneously. If none of the previous conditions for detaching the load occurs, then the load may not be detached from the UUV.

Although specific embodiments were described herein, the scope is not limited to those specific embodiments. Rather, the scope is defined by the following claims and any equivalents thereof.

The invention claimed is:

1. A recovery system for an Unmanned Underwater Vehicle (UUV), the recovery system comprising:
- a detachable load that renders the UUV neutrally buoyant in water; and
- a plurality of release mechanisms configured to detach the load to render the UUV positively buoyant in the water, the release mechanisms comprising:
  - a first release mechanism configured to detach the load in response to a command signal;
  - a second release mechanism comprising a passive galvanic time-in-water release mechanism configured to detach the load in response to the UUV being submerged in the water beyond a threshold time; and
  - a third release mechanism configured to detach the load in response to the UUV exceeding a maximum depth in the water.

2. The recovery system of claim 1 further comprising:
- a disk mechanically coupled to the load;
- wherein the plurality of release mechanisms are configured to detachably couple to the disk at substantially equidistant points around the disk.

3. The recovery system of claim 2 wherein:
- the disk is configured to tilt in response to at least one of the release mechanisms detaching from the disk, and to decouple from release mechanisms that remain coupled to the disk.

4. The recovery system of claim 1 wherein:
- the first release mechanism is configured to detach the load in response to a command signal from the UUV.

5. The recovery system of claim 1 wherein:
- the third release mechanism comprises a passive pressure-actuated release mechanism.

6. The recovery system of claim 1 wherein:
- the load comprises a portion of the UUV.

7. The recovery system of claim 1 wherein:
- the load comprises a drop weight.

8. The recovery system of claim 1 further comprising:
- a housing surrounding the release mechanisms; and
- a weight distribution plate mechanically coupled to the load;
- wherein the first release mechanism comprises:
  - a first fixed arm coupled to the housing;
  - a first movable arm that supports the weigh distribution plate in place relative to the first fixed arm;
  - a first pin coupling the first fixed arm to the first movable arm; and
  - an actuator coil detachably coupling the first movable arm to the first fixed arm and configured to allow the first movable arm to rotate at the first pin to remove support for the weight distribution plate in response to the command signal.

9. The recovery system of claim 8 wherein the second release mechanism comprises:
- a second fixed arm coupled to the housing;
- a second movable arm that supports the weight distribution plate in place relative to the second fixed arm;
- a second pin coupling the second fixed arm to the second movable arm; and
- a corrodible link detachably coupling the second movable arm to the second fixed arm and configured to allow the second movable arm to rotate at the second pin to remove support for the weight distribution plate in response to the UUV being submerged in the water beyond the threshold time.

10. The recovery system of claim 9 wherein the third release mechanism comprises:

a third fixed arm coupled to the housing;

a third movable arm that supports the weight distribution plate in place relative to the third fixed arm;

a third pin coupling the third fixed arm to the third movable arm; and a burst plug detachably coupling the third movable arm to the third fixed arm and configured to allow the third movable arm to rotate at the third pin to remove support for the weight distribution plate in response to the UUV exceeding the maximum depth in the water.

11. A recovery system for an Unmanned Underwater Vehicle (UUV), the recovery system comprising:

a detachable load configured to render the UUV positively buoyant in water upon release;

a first release mechanism configured to release the load from the UUV in response to a command signal;

a second release mechanism comprising a passive galvanic time-in-water release mechanism configured to release the load from the UUV in response to the UUV being submerged in the water beyond a threshold time; and a third release mechanism configured to release the load from the UUV in response to the UUV exceeding a maximum depth in the water.

12. The recovery system of claim 11 wherein:

the third release mechanism comprises a passive pressure-actuated release mechanism.

13. The recovery system of claim 11 wherein:

the load comprises a portion of the UUV.

14. The recovery system of claim 11 wherein:

the load comprises a drop weight.

15. A method for operating a recovery system for an Unmanned Underwater Vehicle (UUV), the method comprising:

affixing a detachable load that renders the UUV neutrally buoyant in water;

detaching the load in response to a command signal to render the UUV positively buoyant in the water;

detaching the load utilizing a passive galvanic time-in-water release mechanism in response to the UUV being submerged in the water beyond a threshold time to render the UUV positively buoyant in the water; and detaching the load in response to the UUV exceeding a maximum depth in the water to render the UUV positively buoyant in the water.

16. The method of claim 15 wherein:

the load comprises a portion of the UUV.

17. The method of claim 15 wherein:

the load comprises a drop weight.

18. The method of claim 15 wherein:

the command signal comprises a signal generated by the UUV.

19. A recovery system for an Unmanned Underwater Vehicle (UUV), the recovery system comprising:

a detachable load that renders the UUV neutrally buoyant in water;

a disk mechanically coupled to the load; and a plurality of release mechanisms configured to detach the load to render the UUV positively buoyant in the water, wherein the plurality of release mechanisms are configured to detachably couple to the disk at substantially equidistant points around the disk, the release mechanisms comprising:

a first release mechanism configured to detach the load in response to a command signal;

a second release mechanism configured to detach the load in response to the UUV being submerged in the water beyond a threshold time; and a third release mechanism configured to detach the load in response to the UUV exceeding a maximum depth in the water.

* * * * *